US012503652B1

(12) United States Patent
Xiong et al.

(10) Patent No.: US 12,503,652 B1
(45) Date of Patent: Dec. 23, 2025

(54) METHOD FOR CORRECTING MOVABLE HYDROCARBON CONTENT OF HIGH GAS-OIL RATIO SHALE OIL BASED ON PHASE BEHAVIOR AND ROCK PYROLYSIS

(71) Applicant: Southwest Petroleum University, Chengdu (CN)

(72) Inventors: Yu Xiong, Chengdu (CN); Daoming Wu, Chengdu (CN); Mingqiu Li, Chengdu (CN); Aoran Leng, Chengdu (CN); Kai Yu, Chengdu (CN); Shasha Li, Weinan (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 19/254,652

(22) Filed: Jun. 30, 2025

(30) Foreign Application Priority Data

Jul. 25, 2024 (CN) ..... 202411001528.0

(51) Int. Cl.
*C10G 1/00* (2006.01)

(52) U.S. Cl.
CPC ..... *C10G 1/008* (2013.01); *C10G 2300/4006* (2013.01); *C10G 2300/4012* (2013.01)

(58) Field of Classification Search
CPC ..... C10G 1/00; C10G 1/008
See application file for complete search history.

(56) References Cited

PUBLICATIONS

Q. Zhi et al., Correction of Light and Heavy Hydrocarbons and Their Application in a Shale Oil Reservoir in Gaoyou Sag, Subei Basin—A Case Study from Well SX84, 11 Processes 572(1-12) (2023).*
CNIPA, Notification of First Office Action for CN202411001528.0, Feb. 9, 2025.
Southwest Petroleum University (Applicant), Replacement claims (allowed) of CN202411001528.0, Feb. 10, 2025.
CNIPA, Notification to grant patent right for invention in CN202411001528.0, Mar. 12, 2025.

* cited by examiner

*Primary Examiner* — Randy Boyer
(74) *Attorney, Agent, or Firm* — Zhigang Ma

(57) ABSTRACT

A method for correcting a movable hydrocarbon content of high gas-oil ratio shale oil based on phase behavior and rock pyrolysis includes: S1, simulating and preparing a fluid under original formation conditions based on formation fluid properties of a target block; S2, performing a pressure-volume-temperature (PVT) experiment and a fluid property test on the fluid prepared in the step S1 to obtain a composition of well fluid and a deviation factor; S3, establishing a theoretical shale movable hydrocarbon content prediction model to calculate a shale theoretical movable hydrocarbon content and a light hydrocarbon correction factor, and S4, determining, based on the light hydrocarbon correction factor obtained in the step S3, a restored light hydrocarbon content of shale oil and a restored original total oil content. This method, considering geological conditions and fluid properties of various shale oil reservoirs, corrects the movable hydrocarbon content of high gas-oil ratio shale oil.

3 Claims, 2 Drawing Sheets

METHOD FOR CORRECTING MOVABLE HYDROCARBON CONTENT OF HIGH GAS-OIL RATIO SHALE OIL BASED ON PHASE BEHAVIOR AND ROCK PYROLYSIS

CROSS-REFERENCE TO RELATED APPLICATION

This application claims priority to Chinese Patent Application No. 202411001528.0, filed on Jul. 25, 2024, which is herein incorporated by reference in its entirety.

TECHNICAL FIELD

The disclosure relates to the field of shale gas development technologies, and more particularly to a method for correcting a movable hydrocarbon content of high gas-oil ratio shale oil based on phase behavior and rock pyrolysis.

BACKGROUND

Nowadays, the supply of conventional oil and gas resources is increasingly unable to meet the growing energy demands, leading to a rapid escalation in the supply-demand contradiction of oil and gas energy. Unconventional oil and gas energy is playing an increasingly significant role in energy supply, and the exploration and development of shale oil and gas are gaining more attention. As a crucial part of oil and gas exploration, resource estimation is one of the essential steps of shale oil exploration. Parameters used in the evaluation of shale oil resources are significantly different from those used in the evaluation of the conventional oil and gas resources. Previous studies have proposed using a pyrolysis parameter $S_1$, which reflects a hydrocarbon content of shale, for resource evaluation of shale oil. However, in an actual experimental analysis process, the pyrolysis parameter $S_1$ suffers from a loss of light hydrocarbons due to core extraction methods, core storage conditions, experimental testing techniques, and the adsorption and swelling effects of kerogen. This results in a measured $S_1$ value being lower than an actual in-situ oil content of the shale oil, making it difficult to directly reflect the in-situ oil content of the shale oil.

At present, in the related art, a light hydrocarbon recovery amount and difference values in pyrolysis of samples before and after oil extraction are used to restore a total oil content $S_c$ of the shale as that: $S_c=S_0+\Delta S_1+\Delta S_2$. This method only accounts for losses of gaseous hydrocarbons $C_{1\text{-}5}$ in the recovery of the light hydrocarbons and does not consider losses of light hydrocarbon components $C_{5\text{-}14}$ during core drilling and long-term storage of cores in core repositories. This oversight leads to inaccurate evaluations of oil content after light hydrocarbon recovery, resulting in deviations from actual values. Therefore, it is necessary to develop a method for correcting a movable hydrocarbon content of high gas-oil ratio shale oil based on phase behavior and rock pyrolysis.

SUMMARY

A purpose of the disclosure is to provide a method for correcting a movable hydrocarbon content of high gas-oil ratio shale oil based on phase behavior and rock pyrolysis. This method solves a technical problem that existing methods in the related art focus on correcting resource quantities of low gas-oil ratio shale oil reservoirs with high maturity and minimal light hydrocarbon components, while neglecting substantial light hydrocarbon components and significant light hydrocarbon losses in volatile oil reservoirs and condensate oil reservoirs with high gas-oil ratios.

To achieve the above purpose, the disclosure provides the following technical solution. Specifically, a method for correcting a movable hydrocarbon content of high gas-oil ratio shale oil based on phase behavior and rock pyrolysis, includes following steps:

S1, simulating and preparing a fluid under original formation conditions based on formation fluid properties of a target block;

S2, performing a pressure-volume-temperature (PVT) experiment and a fluid property test on the fluid prepared in the step S1 to obtain a composition of well fluid and a deviation factor;

S3, establishing a theoretical shale movable hydrocarbon content prediction model to calculate a shale theoretical movable hydrocarbon content and a light hydrocarbon correction factor; and S4, determining, based on the light hydrocarbon correction factor obtained in the step S3, a restored light hydrocarbon content of shale oil and a restored original total oil content.

In some embodiments, the method further includes: determining, based on the restored light hydrocarbon content of shale oil and the restored original total oil content, the target block whether as a to-be-exploited region; and in response to the target block is determined as the to-be-exploited region, exploiting shale oil from the to-be-exploited region.

In some embodiments, the formation fluid properties of the target block in the step S1 include a formation temperature, a formation pressure, a gas-oil ratio, and a deviation factor.

In some embodiments, the theoretical shale movable hydrocarbon content prediction model in the step S3 is as follows:

$$S_{KD} = \frac{P_p V_b \phi S_0 M \times 10^6}{ZRT_p m_b} \tag{1}$$

where $S_{KD}$ represents the shale theoretical movable hydrocarbon content, in a unit of milligram per gram (mg/g); $P_p$ represents a formation pressure, in a unit of megapascal (MPa); $V_b$ represents a volume of a core sample, in a unit of cubic meter ($m^3$); $\phi$ represents a porosity of the core sample, in percentage (%); $S_0$ represents an oil saturation of the core sample, in percentage (%); M represents a relative molecular weight, dimensionless; Z represents the deviation factor, dimensionless; R represents a molar gas constant 0.008314; $T_p$ represents a formation temperature, in a unit of Kelvin (K); and mb represents a weight of the core sample, in a unit of gram (g).

In some embodiments, due to a significant loss of light hydrocarbons in the stored ordinary core sample, a calculated movable hydrocarbon content includes all components of free hydrocarbons. Therefore, it is necessary to further determine the light hydrocarbon correction factor, i.e., a ratio of a difference between the shale theoretical movable hydrocarbon content $S_{KD}$ and the total light hydrocarbon content $S_{1total}$ obtained from the segmented pyrolysis of the ordinary core sample to the total light hydrocarbon content $S_{1total}$.

The light hydrocarbon correction factor is calculated as per the following formula:

$$K = \frac{S_{KD} - S_{1total}}{S_{1total}} \quad (2)$$

K represents the light hydrocarbon correction factor, dimensionless; and $S_{1total}=S_{1-1}+S_{1-2}$, where $S_{1-1}$ represents a content of light oil, $S_{1-2}$ represents a content of light-medium oil, and $S_{1total}$ represents a total light hydrocarbon content.

In some embodiments, in the step S4, the restored light hydrocarbon content of shale oil is calculated as per the following formula:

$$S_{light\ hydrocarbon}=KS_{1total}+S_{1total} \quad (3)$$

The restored original total oil content is calculated as per the following formula:

$$S_{TOL}=KS_{1total}+S_{1total}+S_{2-1} \quad (4)$$

where $S_{2-1}$ represents a content of light-heavy oil.

Compared to the related art, the disclosure may achieve the following beneficial effects.

The disclosure takes into full account actual geological conditions of a reservoir site and fluid characteristics of different types of shale oil reservoirs. Based on fluid property characteristics of the high gas-oil ratio shale oil reservoir, where light components have a high proportion and strong volatility, and by integrating the PVT experiment with an existing rock pyrolysis method, the movable hydrocarbon content of the high gas-oil ratio shale oil is corrected. This allows the pyrolysis parameter S1 of shale to more objectively and accurately represent the shale movable hydrocarbon content.

DETAILED DESCRIPTION OF EMBODIMENTS

Below, technical solutions in embodiments of the disclosure will be clearly and completely described in conjunction with attached drawings. Apparently, the described embodiments are only some of embodiments of the disclosure, and not all of embodiments of the disclosure. Based on the described embodiments of the disclosure, all other embodiments obtained by those skilled in the art without creative labor are within the scope of protection of the disclosure.

Figure 1:
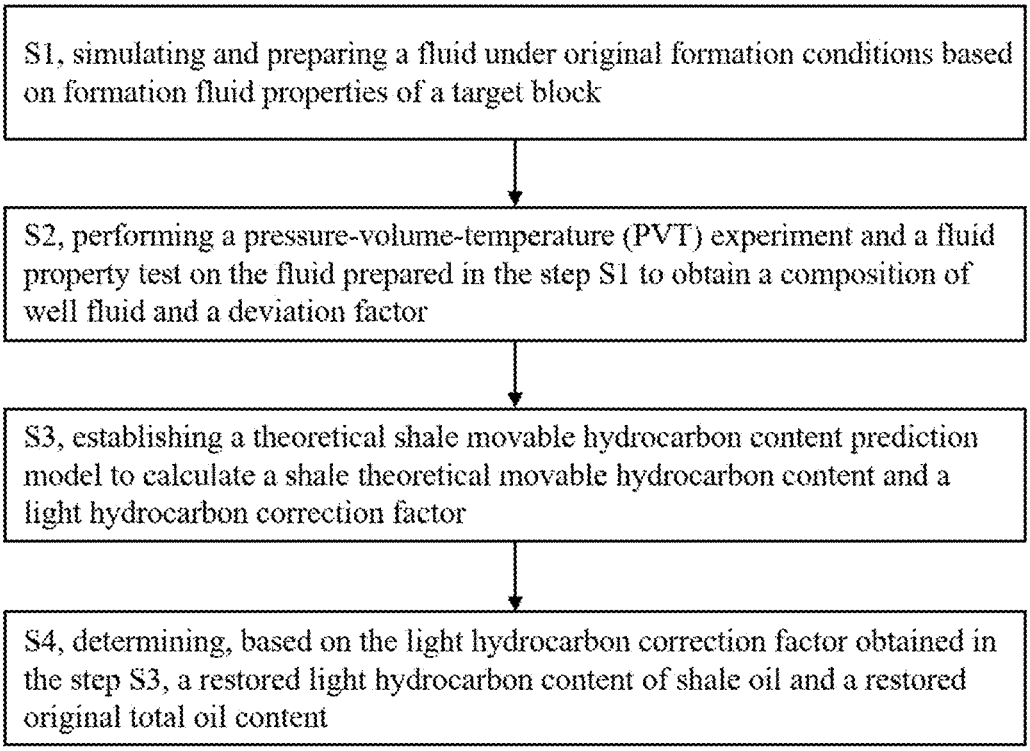
FIG. 1 illustrates a schematic flowchart of a method for correcting a movable hydrocarbon content of high gas-oil ratio shale oil based on phase behavior and rock pyrolysis provided by the disclosure.
Figure 2:
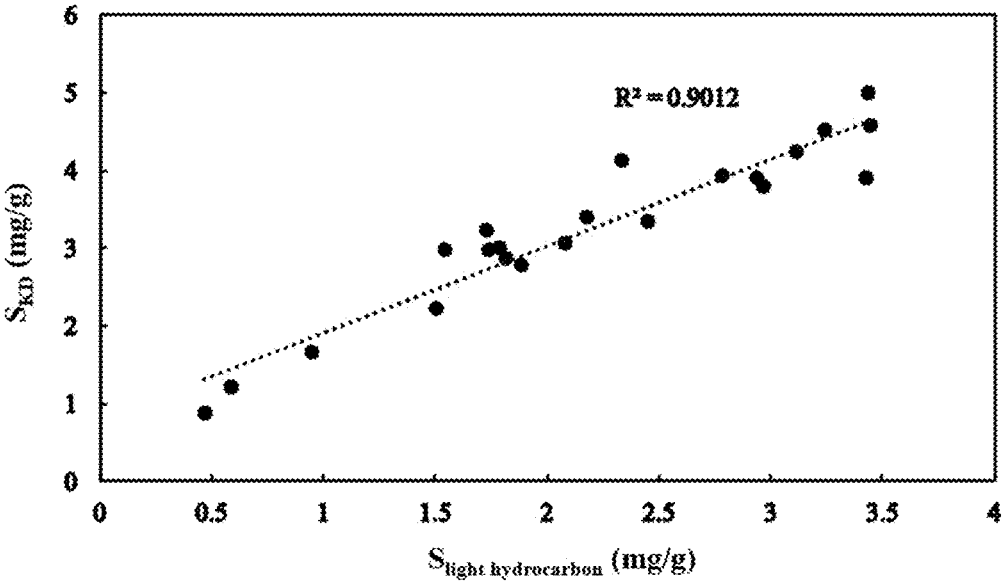
FIG. 2 illustrates a schematic diagram of light hydrocarbon contents in segmented pyrolysis of core samples and calculated movable hydrocarbon contents according to an embodiment of the disclosure.
Figure 3:
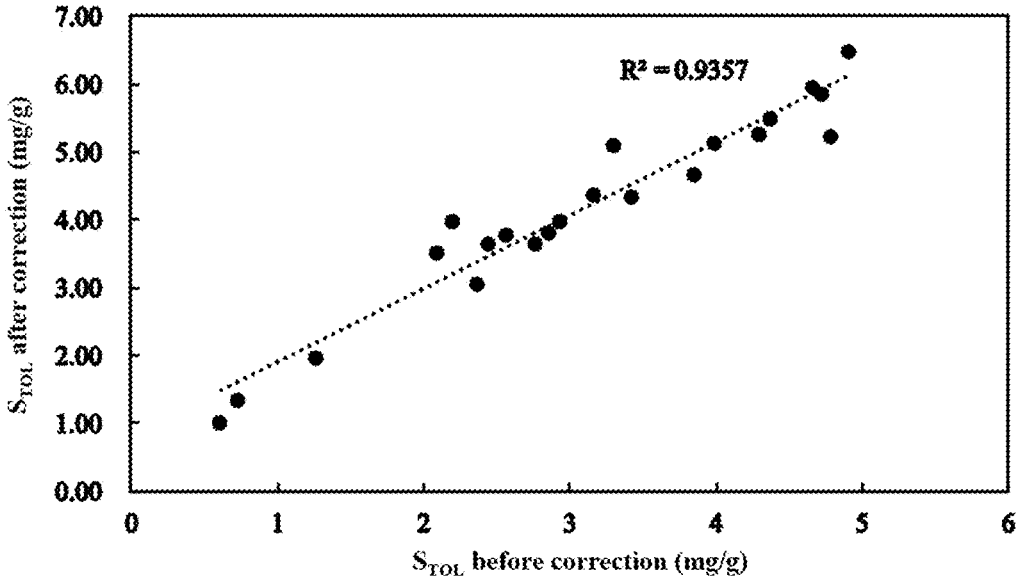
FIG. 3 illustrates a schematic diagram of total oil contents in the segmented pyrolysis of the core samples and corrected total oil contents according to the embodiment of the disclosure.

Referring to FIG. 1 through FIG. 3, a method for correcting a movable hydrocarbon content of high gas-oil ratio shale oil based on phase behavior and rock pyrolysis according to an embodiment of the disclosure is provided. The method includes following steps.

S1, a formation fluid (i.e., a fluid under original formation conditions) is prepared based on formation fluid properties of an acquired target block. Specifically, a formation temperature and a formation pressure are inferred from a gas-oil ratio obtained from a hydrocarbon generation experiment and a formation depth of a formation fluid in the target block, to stimulate and prepare the fluid under original formation conditions.

S2, a PVT experiment and a fluid property test are performed on the formation fluid prepared in the step S1 to obtain a composition of well fluid, a deviation factor, a viscosity of the prepared formation fluid, and a condensate oil density. The composition of well fluid includes carbon dioxide ($CO_2$), nitrogen ($N_2$), methane ($C_1$), ethane ($C_2$), propane ($C_3$), isobutane ($iC_4$), normal butane ($nC_4$), isopentane ($iC_5$), normal pentane ($nC_5$), hexane ($C_6$), heptane ($C_7$), octane ($C_8$), nonane ($C_9$), decane ($C_{10}$), undecane and heavier hydrocarbons ($C_{11+}$), etc. In addition, basic data of a core sample are tested, including a volume, a dry weight, a porosity, an oil saturation, and a density.

S3, a theoretical shale movable hydrocarbon content prediction model is established to calculate a shale theoretical movable hydrocarbon content and a light hydrocarbon correction factor. Specifically, a segmented pyrolysis (also referred to as stepwise pyrolysis) method is used/employed for an ordinary shale core sample to establish a correction model associated with the shale theoretical movable hydrocarbon content $S_{KD}$ and a total light hydrocarbon content (also referred to a total content of light hydrocarbons) $S_{1total}$ obtained from segmented pyrolysis of the ordinary shale core sample.

Specific operations of the segmented pyrolysis method are as follows.

The core sample is crushed to less than 100 meshes, and a segmented temperature rise pyrolysis experiment is performed by using a rock pyrolysis analyzer to measure a content of light oil $S_{1-1}$, a content of light-medium oil $S_{1-2}$, and a content of light-heavy oil $S_{2-1}$. Specifically, $S_{1-1}$ corresponds to hydrocarbons with a carbon number roughly ranging from $C_7$ to $C_{14}$, and these hydrocarbons are considered a mobile fraction of light oil and are decomposed and released at a temperature of 200° C. $S_{1-2}$ corresponds to hydrocarbons with a carbon number roughly ranging from $C_{14}$ to $C_{25}$, and these hydrocarbons are decomposed and released at a temperature ranging from 200° C. to 350° C. $S_{2-1}$ corresponds to hydrocarbons with a carbon number roughly ranging from $C_{25}$ to $C_{38}$, and theses hydrocarbons are mainly adsorbed in form of colloids, asphaltenes, and heavy hydrocarbons, and are decomposed and released at a temperature range ranging from 350° C. to 450° C. Light hydrocarbons specifically refer to hydrocarbons with a carbon number ranging from $C_1$ to $C_{14}$. Due to a significant loss of the light hydrocarbons in the ordinary shale core sample during storage, a calculated movable hydrocarbon content includes all components of free hydrocarbons. Therefore, it is necessary to further determine the light hydrocarbon correction factor, i.e., a ratio of a difference between the shale theoretical movable hydrocarbon content $S_{KD}$ and the total light hydrocarbon content $S_{1total}$ obtained from the segmented pyrolysis of the ordinary shale core sample to the total light hydrocarbon content $S_{1total}$.

The theoretical shale movable hydrocarbon content prediction model is as follows:

$$S_{KD} = \frac{P_p V_b \phi S_0 M \times 10^6}{ZRT_p m_b} \quad (1)$$

where $S_{KD}$ represents the shale theoretical movable hydrocarbon content, in a unit of mg/g; $P_p$ represents a formation pressure, in a unit of MPa; $V_b$ represents the volume of the core sample, in a unit of $m^3$; $\phi$ represents the porosity of the core sample, in percentage (%); $S_0$ represents the oil saturation of the core sample, in percentage (%); M represents a relative molecular weight, dimensionless; Z represents the deviation factor, dimensionless; R represents a molar gas constant 0.008314; $T_p$ represents a formation temperature, in a unit of K; and mb represents a weight of the core sample, in a unit of g.

The light hydrocarbon correction factor is calculated as per the following formula:

$$K = \frac{S_{KD} - S_{1total}}{S_{1total}} \tag{2}$$

where K represents the light hydrocarbon correction factor, dimensionless; $S_{KD}$ represents the shale theoretical movable hydrocarbon content, in the unit of mg/g; and $S_{1total}=S_{1-1}+S_{1-2}$, where $S_{1-1}$ represents the content of light oil, $S_{1-2}$ represents the content of light-medium oil, and $S_{1total}$ represents the total light hydrocarbon content.

S4, based on the light hydrocarbon correction factor obtained in the step S3, a corrected light hydrocarbon content and a corrected original total oil content are determined.

A calculation expression for the corrected/restored light hydrocarbon content of shale oil is as follows:

$$S_{light\ hydrocarbon}=KS_{1total}+S_{1total} \tag{3}$$

A calculation expression for the corrected/restored original total oil content is as follows:

$$S_{TOL}=KS_{1total}+S_{1total}+S_{2-1} \tag{4}$$

where $S_{2-1}$ represents the content of light-heavy oil.

In a specific embodiment, a high gas-oil ratio shale oil reservoir (i.e., a target shale oil reservoir) is used as an example. The method provided by the disclosure is used to correct an original total oil content of the target shale oil reservoir. Specific steps are as follows.

1, Formation fluid data of a target well is obtained, as shown in Table 1.

TABLE 1 fluid property data of the target shale oil reservoir

| pressure (MPa) | temperature (K) | gas-oil ratio ($m^3/m^3$) | deviation factor |
|---|---|---|---|
| 30 | 362.15 | 1000 | 1.1129 |

2, A viscosity of the prepared formation fluid is 0.256 millipascal-second (mPa·s), and a condensate oil density is 0.8024 grams per cubic centimeter (g/$cm^3$). A composition of the prepared formation fluid is calculated, as shown in Table 2.

TABLE 2 composition of well fluid

| components | relative molecular weight | oil components % (mole fraction) | gas components % (mole fraction) | well fluid components % (mole fraction) |
|---|---|---|---|---|
| $CO_2$ | 44 | 0.00 | 0.69 | 0.65 |
| $N_2$ | 26 | 0.00 | 1.01 | 0.96 |
| $C_1$ | 16 | 0.00 | 79.35 | 74.93 |
| $C_2$ | 30 | 0.00 | 11.54 | 10.89 |
| $C_3$ | 44 | 0.00 | 4.84 | 4.57 |
| $iC_4$ | 58 | 0.09 | 0.64 | 0.61 |
| $nC_4$ | 58 | 0.05 | 1.14 | 1.08 |
| $iC_5$ | 72 | 0.18 | 0.31 | 0.31 |
| $nC_5$ | 72 | 0.25 | 0.26 | 0.26 |
| $C_6$ | 86 | 1.18 | 0.18 | 0.24 |
| $C_7$ | 100 | 4.6 | 0.04 | 0.29 |
| $C_8$ | 114 | 4.26 | 0.00 | 0.24 |
| $C_9$ | 128 | 3.69 | 0.00 | 0.21 |
| $C_{10}$ | 142 | 5.28 | 0.00 | 0.29 |
| $C_{11+}$ | 172.4 | 80.42 | 0.00 | 4.48 |

3, Basic data of tested core samples are shown in table 3.

TABLE 3 basic data of core samples

| core sample serial number | volume ($cm^3$) | dry weight (g) | porosity (%) | oil saturation (%) | density (g/$cm^3$) |
|---|---|---|---|---|---|
| 1 | 43.29657 | 91.712 | 4.952 | 37.78 | 2.118227841 |
| 2 | 31.88601 | 83.002 | 2.521541 | 36.42 | 2.603085177 |
| 3 | 26.13408 | 40.509 | 4.872376 | 38.86 | 1.550044999 |
| 4 | 35.53108 | 81.207 | 7.077 | 37.13 | 2.28552017 |
| 5 | 29.89767 | 42.085 | 6.979 | 36.96 | 1.407634776 |
| 6 | 49.79016 | 98.013 | 7.892 | 38.94 | 1.968521491 |
| 7 | 28.78569 | 51.973 | 6.93 | 30.88 | 1.805515171 |
| 8 | 17.63145 | 41.5 | 3.985 | 28.74 | 2.353748557 |
| 9 | 27.79489 | 50.011 | 6.895 | 34.88 | 1.799287567 |
| 10 | 24.21509 | 58.073 | 4.8758 | 32.45 | 2.398215328 |
| . . . | . . . | . . . | . . . | . . . | . . . |

4, A movable hydrocarbon content (i.e., the shale theoretical movable hydrocarbon content) $S_{KD}$ of each core sample is calculated.

Based on different core samples, the movable hydrocarbon content $S_{KD}$ of each core sample is calculated as per the formula (1), and calculation results are shown in Table 4.

TABLE 4 calculation results of movable hydrocarbon content for different core samples

| | serial number | | | | |
|---|---|---|---|---|---|
| | 1 | 2 | 3 | 4 | 5 |
| $S_{KD}$ | 0.465 | 0.88 | 0.471 | 0.582 | 0.33 |
| | serial number | | | | |
| | 6 | 7 | 8 | 9 | 10 |
| $S_{KD}$ | 0.33 | 0.706 | 1.065 | 0.366 | 0.739 |

5, Segmental pyrolysis is performed on each ordinary core sample to establish a correction model associated with a total light hydrocarbon content $S_{1total}$ obtained from segmental pyrolysis of each ordinary core sample and the theoretical shale movable hydrocarbon content $S_{KD}$.

A Segmental pyrolysis experiment is performed on the core samples, and a light hydrocarbon correction factor of each core sample is calculated according to the formula (2). Calculation results are shown in Table 5, and in Table 5, $S_{2-2}$ corresponds to hydrocarbons with a carbon number ranging from $C_{38}$ to $C_{60}$.

TABLE 5 results of segmental pyrolysis and light hydrocarbon correction

| core sample serial number | $S_{1-1}$ (mg/g) | $S_{1-2}$ (mg/g) | $S_{2-1}$ (mg/g) | $S_{2-2}$ (mg/g) | $S_{1-1}$ + $S_{1-2}$ (mg/g) | K |
|---|---|---|---|---|---|---|
| 1 | 0.29 | 1.22 | 0.86 | 0.72 | 1.51 | 0.464856 |
| 2 | 0.14 | 0.33 | 0.14 | 0.23 | 0.47 | 0.879844 |
| 3 | 0.41 | 1.67 | 0.77 | 1.01 | 2.08 | 0.470747 |
| 4 | 0.22 | 1.6 | 1.11 | 0.91 | 1.82 | 0.582048 |
| 5 | 0.61 | 2.84 | 1.28 | 1.82 | 3.45 | 0.330204 |
| 6 | 0.43 | 2.51 | 1.35 | 1.31 | 2.94 | 0.329834 |
| 7 | 0.21 | 1.53 | 0.82 | 0.71 | 1.74 | 0.705934 |
| 8 | 0.16 | 0.43 | 0.14 | 0.38 | 0.59 | 1.065404 |
| 9 | 0.35 | 2.1 | 0.98 | 0.88 | 2.45 | 0.3663 |
| 10 | 0.23 | 0.72 | 0.31 | 0.24 | 0.95 | 0.739205 |
| . . . | . . . | . . . | . . . | . . . | . . . | . . . |

6, A corrected original total oil content STOL of each core sample is calculated.

The corrected original total oil content STOL of each core sample is calculated as per the formula (3), and calculation results are shown in Table 6.

TABLE 6 results of corrected original total oil content

| | serial number | | | | |
|---|---|---|---|---|---|
| | 1 | 2 | 3 | 4 | 5 |
| $S_{TOL}$ | 3.072 | 1.024 | 3.829 | 3.989 | 5.869 |
| | serial number | | | | |
| | 6 | 7 | 8 | 9 | 10 |
| $S_{TOL}$ | 5.26 | 3.788 | 1.359 | 4.327 | 1.962 |

As shown in FIG. 2 and FIG. 3, the theoretical shale movable hydrocarbon content and the total oil content are compared with the experimentally measured values. It is found that calculated results have a good correlation with measured results, with a correlation coefficient $R^2>0.9$. This indicates that the method can be effectively used for the correction of movable hydrocarbon content in high gas-oil ratio shale oil.

The above is only a specific implementation of the disclosure, but the scope of protection of the disclosure is not limited to this. Those skilled in the art can easily think of changes or replacements within the technical scope disclosed in the disclosure, which should be included in the scope of protection of the disclosure. Therefore, the scope of protection of the disclosure should be determined by the scope of protection defined by the appended claims.

What is claimed is:

1. A method for correcting a movable hydrocarbon content of shale oil based on phase behavior and rock pyrolysis, comprising following steps:

S1, simulating and preparing a fluid under original formation conditions based on formation fluid properties of a target block;

S2, performing a pressure-volume-temperature (PVT) experiment and a fluid property test on the fluid prepared in the step S1 to obtain a composition of well fluid and a deviation factor;

S3, establishing a theoretical shale movable hydrocarbon content prediction model to calculate a shale theoretical movable hydrocarbon content and a light hydrocarbon correction factor;

wherein the theoretical shale movable hydrocarbon content prediction model is as follows:

$$S_{KD} = \frac{P_p V_b \phi S_0 M \times 10^6}{ZRT_p m_b} \quad (1)$$

where $S_{KD}$ represents the shale theoretical movable hydrocarbon content, in a unit of milligram per gram (mg/g); $P_p$ represents a formation pressure, in a unit of megapascal (MPa); $V_b$ represents a volume of a core sample, in a unit of cubic meter ($m^3$); $\phi$ represents a porosity of the core sample, in percentage (%); $S_0$ represents an oil saturation of the core sample, in percentage (%); M represents a relative molecular weight of the fluid as simulated, dimensionless; Z represents the deviation factor, dimensionless; R represents a molar gas constant 0.008314; $T_p$ represents a formation temperature, in a unit of Kelvin (K); and $m_b$ represents a weight of the core sample, in a unit of gram (g);

wherein the light hydrocarbon correction factor is calculated as per the following formula:

$$K = \frac{S_{KD} - S_{1total}}{S_{1total}} \quad (2)$$

where K represents the light hydrocarbon correction factor, dimensionless; $S_{KD}$ represents the shale theoretical movable hydrocarbon content, in the unit of mg/g; and $S_{1total}=S_{1-1}+S_{1-2}$, where $S_{1-1}$ represents a content of light oil, $S_{1-2}$ represents a content of light-medium oil, and $S_{1total}$ represents a total light hydrocarbon content;

S4, determining, based on the light hydrocarbon correction factor obtained in the step S3, a restored light hydrocarbon content of shale oil and a restored original total oil content; and S5, determining, based on the restored light hydrocarbon content of shale oil and the restored original total oil content, the target block whether as a to-be-exploited region; and in response to the target block is determined as the to-be-exploited region, exploiting shale oil from the to-be-exploited region.

2. The method for correcting a movable hydrocarbon content of shale oil based on phase behavior and rock pyrolysis as claimed in claim 1, wherein the formation fluid properties of the target block in the step S1 comprise a formation temperature, a formation pressure, a gas-oil ratio, and a deviation factor.

3. The method for correcting a movable hydrocarbon content of shale oil based on phase behavior and rock pyrolysis as claimed in claim 1, wherein in the step S4, the restored light hydrocarbon content of shale oil is calculated as per the following formula:

$$S_{light\ hydrocarbon}=KS_{1total}+S_{1total} \quad (3)$$

wherein the restored original total oil content is calculated as per the following formula:

$$S_{TOL}=KS_{1total}+S_{1total}+S_{2\text{-}1} \quad (4)$$

where $S_{2\text{-}1}$ represents a content of light-heavy oil.

* * * * *